US009315057B2

(12) United States Patent
Kanemoto

(10) Patent No.: US 9,315,057 B2
(45) Date of Patent: Apr. 19, 2016

(54) BELT CLEANING APPARATUS AND RECORDING APPARATUS

(71) Applicant: SEIKO EPSON CORPORATION, Tokyo (JP)

(72) Inventor: Shuichi Kanemoto, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/154,232

(22) Filed: Jan. 14, 2014

(65) Prior Publication Data

US 2014/0198161 A1 Jul. 17, 2014

(30) Foreign Application Priority Data

Jan. 16, 2013 (JP) ..... 2013-005188
Jan. 16, 2013 (JP) ..... 2013-005277
Oct. 30, 2013 (JP) ..... 2013-225059

(51) Int. Cl.
*B41J 2/165* (2006.01)
*B41J 29/17* (2006.01)
*B41J 11/00* (2006.01)

(52) U.S. Cl.
CPC ..... *B41J 29/17* (2013.01); *B41J 11/007* (2013.01)

(58) Field of Classification Search
CPC ..... B41J 29/17; B41J 11/007
USPC ..... 347/21, 22, 28, 33, 104, 103; 198/493–495, 499
See application file for complete search history.

(56) References Cited

U.S. PATENT DOCUMENTS

| | | | | |
|---|---|---|---|---|
| 4,860,883 | A * | 8/1989 | Knaul et al. | 198/495 |
| 5,507,876 | A * | 4/1996 | Wandres | 134/9 |
| 6,352,084 | B1 * | 3/2002 | Oshinowo | 134/182 |
| 6,945,383 | B2 * | 9/2005 | Pham | 198/495 |
| 6,971,503 | B2 * | 12/2005 | Thompson | 198/494 |
| 8,191,701 | B2 * | 6/2012 | Bryl et al. | 198/495 |
| 2005/0168521 | A1 | 8/2005 | Suzuki et al. | |
| 2005/0178281 | A1 | 8/2005 | Berg et al. | |
| 2007/0146460 | A1 | 6/2007 | Gordon et al. | |

(Continued)

FOREIGN PATENT DOCUMENTS

| | | |
|---|---|---|
| EP | 1 674 268 | 6/2006 |
| JP | 2004-136534 | 5/2004 |

(Continued)

OTHER PUBLICATIONS

European Search Report for Application No. 14151097.4 dated Jul. 10, 2015.

*Primary Examiner* — Henok Legesse
(74) *Attorney, Agent, or Firm* — Workman Nydegger

(57) ABSTRACT

A belt cleaning apparatus that is a cleaning apparatus that cleans a surface of a transporting belt with a cleaning solution, the belt cleaning apparatus including a cleaning member that is in contact with the surface in a rotatable manner, the cleaning member cleaning the surface with the cleaning solution; a cleaning solution reservoir that retains the cleaning solution; and a partition portion that protrudes from a bottom portion of the cleaning solution reservoir, the partition portion partitioning the cleaning solution reservoir into a cleaning area where the cleaning member is partially dipped in the cleaning solution and a discharging area from where the cleaning solution is discharged. In the belt cleaning apparatus, a distance between the cleaning member and the partition portion becomes gradually smaller towards an upper end of the partition portion.

18 Claims, 5 Drawing Sheets

(56) References Cited

U.S. PATENT DOCUMENTS

| | | | | |
|---|---|---|---|---|
| 2008/0107461 | A1* | 5/2008 | Miyata et al. | 399/343 |
| 2008/0218550 | A1 | 9/2008 | Tsuji et al. | |

FOREIGN PATENT DOCUMENTS

| | | |
|---|---|---|
| JP | 2004-137034 | 5/2004 |
| JP | 2005-104022 | 4/2005 |
| JP | 2005-212276 | 8/2005 |
| JP | 2005-212277 | 8/2005 |
| JP | 2005-219334 | 8/2005 |
| JP | 2005-319650 | 11/2005 |
| JP | 2006-272834 | 10/2006 |
| JP | 2007-031004 | 2/2007 |
| JP | 2008-044108 | 2/2008 |
| JP | 2008-114991 | 5/2008 |
| JP | 2012-116617 | 6/2012 |
| WO | WO 03/100152 | 12/2003 |

* cited by examiner

BELT CLEANING APPARATUS AND RECORDING APPARATUS

BACKGROUND

1. Technical Field

The present invention relates to a belt cleaning apparatus that cleans a transporting belt that transports an object to be transported and to a recording apparatus provided with the belt cleaning apparatus.

Examples of the recording apparatus of the present application include, for example, an ink jet printer, a line printer, a copying machine, and a facsimile machine.

2. Related Art

Hitherto, ink jet recording apparatuses have been widely used as apparatuses for carrying out recording of high-definition images on recording mediums such as paper and fabric. In particular, when the recording medium is long, a belt conveying device including an endless transporting belt is used to adhere the recording medium to the transporting belt and to transport the recording medium.

Furthermore, in some cases, such a recording apparatus carries out what is called marginless recording. There are cases in which ink ejected from the recording head adheres to the transporting belt when marginless recording is carried out. Furthermore, when there is a feed error of the recording medium or when the recording medium is thin, in some cases, ink adheres to the transporting belt. If the transporting belt is left with the ink adhered thereto, a recording medium that has been newly fed will be smeared with the ink that has adhered to the transporting belt.

Furthermore, there are cases in which foreign matter such as paper powder, yarn waste, or a pretreatment agent adheres to the surface of the transporting belt depending on the type of recording medium on which recording is carried out by the recording apparatus. Accordingly, if the foreign matter that has adhered to the transporting belt is not dealt with, the foreign matter will adhere to the back side of a newly fed recording medium and the quality of the product will be compromised or friction between the transporting belt and the recording medium will be affected rendering the transport of the recording medium unstable.

Accordingly, JP-A-2012-116617 discloses a recording apparatus that is provided with a belt cleaning apparatus that cleans a transporting belt to remove ink, foreign matter, and the like that have adhered to the transporting belt.

The belt cleaning apparatus of the recording apparatus is positioned below a transporting belt that is wound around a driving roller and a driven roller, and a sprinkler pipe, a brush roller, a scraping blade, and a liquid absorbing roller are provided in this order in the movement direction of the transporting belt. The sprinkler pipe ejects a cleaning solution from a portion thereof facing the surface of the transporting belt.

The brush roller is configured to rotate in a direction opposite to the movement direction of the transporting belt and the liquid absorbing roller is configured to rotate in the same direction as the movement direction of the transporting belt. Furthermore, a portion of each of the brush roller and the liquid absorbing roller is dipped in the cleaning solution, which is retained in a cleaning solution reservoir. The scraping blade is positioned between the brush roller and the liquid absorbing roller and is arranged to scrape off foreign matter that is adhering to the surface of the transporting belt.

The brush roller and the scraping blade scrape off the cleaning solution that has been ejected from the sprinkler pipe and that is adhering to the surface of the transporting belt and, thus, remove dirt from the surface of the transporting belt. Now, the removed cleaning solution is received by the cleaning solution reservoir in which a portion of the brush roller is accommodated.

Furthermore, the cleaning solution reservoir is configured to maintain a predetermined liquid level so that the portion of the brush roller is impregnated with the cleaning solution. In other words, in the belt cleaning apparatus, the cleaning solution is supplied from a cleaning solution supply pipe in order to maintain the liquid surface of the cleaning solution in the cleaning solution reservoir at a predetermined liquid level. A supply port of the cleaning solution supply pipe is positioned above the liquid surface of the cleaning solution. The supply port supplies a new cleaning solution that has no dirt therein to the cleaning solution reservoir from above the liquid surface. Furthermore, the cleaning solution reservoir is provided with an overflow pipe. When the liquid surface of the cleaning solution exceeds the predetermined liquid level, the cleaning solution overflows and is discharged from the cleaning solution reservoir through the overflow pipe.

Incidentally, in the cleaning solution reservoir, supply and discharge of the cleaning solution are carried out near the liquid surface of the cleaning solution that is retained in the cleaning solution reservoir; accordingly, the cleaning solution that has become dirty as a result of cleaning the transporting belt, the foreign matter that has been removed from the transporting belt, and the like are not totally discharged from the overflow pipe but rather settle at the bottom portion of the cleaning solution reservoir.

Accordingly, in the belt cleaning apparatus, dirt, foreign matter, and the like that have settled on the bottom portion of the cleaning solution reservoir cannot be aggressively discharged; accordingly, the concentration of dirt in the cleaning solution inside the cleaning solution reservoir rises and the transporting belt is cleaned by a cleaning solution including dirt. As a result, the ability of the cleaning apparatus to clean the transporting belt is hindered.

Furthermore, when the brush roller rotates, the brush roller stirs up the cleaning solution in the cleaning solution reservoir. In such a case, dirt and foreign matter that have settled at the bottom are mixed in the cleaning solution reservoir and some of the dirt and foreign matter adhere to the brush roller. Accordingly, the cleaning solution including dirt, and foreign matter may disadvantageously adhere to the transporting belt once more. Accordingly, efficiency of cleaning of the transporting belt may be disadvantageously hindered.

SUMMARY

An advantage of some aspects of the invention is that a belt cleaning apparatus is provided that can maintain the concentration of dirt in the cleaning solution at or below a predetermined level or that can improve the efficiency of cleaning of the transporting belt.

A belt cleaning apparatus according to a first aspect of the invention is a belt cleaning apparatus that cleans a surface of a transporting belt with a cleaning solution. The belt cleaning apparatus includes a cleaning member that is in contact with the surface in a rotatable manner, in which the cleaning member cleans the surface with the cleaning solution; a cleaning solution reservoir that retains the cleaning solution; and a partition portion that protrudes from a bottom portion of the cleaning solution reservoir, in which the partition portion partitions the cleaning solution reservoir into a cleaning area in which the cleaning member is partially dipped in the cleaning solution and a discharging area from which the cleaning solution is discharged. In the belt cleaning apparatus, a distance between the cleaning member and the partition portion becomes gradually smaller towards an upper end of the partition portion.

According to the first aspect, the distance between the cleaning member and the partition portion becomes gradually smaller towards the upper end of the partition portion. The cleaning solution that is supplied to the cleaning area passes through a flow path formed by the cleaning member and the partition portion and overflows at the upper end of the partition portion. Accordingly, the flow velocity of the cleaning solution increases as the cleaning solution passes through the flow path that becomes gradually narrower. The overflowing cleaning solution washes away dirt on the cleaning member while moving into the discharging area. Therefore, the concentration of dirt in the cleaning solution that is retained in the cleaning area can be maintained at or below a predetermined level and the cleaning member can improve the efficiency with which it cleans the transporting belt.

In the belt cleaning apparatus according to the first aspect, the upper end of the partition portion is preferably positioned below the rotating shaft of the cleaning member.

The upper end of the partition portion is positioned below the rotating shaft of the cleaning member; accordingly, the position where the cleaning solution overflows the upper end is also below the rotating shaft. Accordingly, the cleaning solution, whose flow velocity between the partition portion and the cleaning member is increased, can be discharged into the discharging area.

The belt cleaning apparatus according to the first aspect preferably further includes a cleaning solution supply portion that supplies the cleaning solution to the cleaning area. The cleaning solution supply portion preferably supplies, in the cleaning area, at least a portion of the cleaning solution below the liquid surface of the cleaning solution that is defined by the upper end of the partition portion.

The cleaning solution supply portion supplies, in the cleaning area, at least a portion of the cleaning solution below the liquid surface of the cleaning solution; accordingly, a current is generated in the cleaning solution that is retained in the cleaning area and the distribution of dirt in the cleaning solution is uniformized. Furthermore, in the flow path of the cleaning solution, dirt that has accumulated on the bottom portion of the cleaning area is stirred up towards the liquid surface; accordingly, dirt can be discharged from the cleaning area with the flow of the cleaning solution that overflows at the upper end of the partition portion. As a result, the concentration of dirt in the cleaning solution that is retained in the cleaning area can be maintained at or below a predetermined level.

In the belt cleaning apparatus according to the first aspect, a rotating direction of the cleaning member is preferably opposite to a running direction of the transporting belt.

The cleaning member is rotated in a direction opposite to the running direction of the transporting belt; accordingly, relative speed between the transporting belt and the cleaning member can be increased and the cleaning member can improve the efficiency with which it cleans the transporting belt.

In the belt cleaning apparatus according to the first aspect, a distance between the partition portion and the cleaning member in the running direction of the transporting belt is preferably smaller than a distance between a side wall of the cleaning solution reservoir that is on the side provided with the cleaning solution supply portion and the cleaning member.

The distance between the partition portion and the cleaning member in the transport direction of the transporting belt is smaller than the distance between a side wall of the cleaning solution reservoir that is on the side provided with the cleaning solution supply portion and the cleaning member; accordingly, the pressure and the flow velocity of the cleaning solution between the partition portion and the cleaning member can be increased compared to the pressure and the flow velocity between the side wall of the cleaning solution reservoir and the cleaning member. As a result, the cleaning efficiency of the cleaning member can be improved in the vicinity of the cleaning solution discharge portion.

In the belt cleaning apparatus according to the first aspect, the cleaning solution supply portion preferably includes a guide member that guides the cleaning solution that has been supplied to the cleaning area from the cleaning solution supply portion towards the bottom portion of the cleaning area.

The cleaning solution that has been supplied to the cleaning area is guided by the guide member towards the bottom portion of the cleaning area; accordingly, dirt and the like that have accumulated on the bottom portion of the cleaning area can be carried away towards the cleaning solution discharge portion. Furthermore, since a clean cleaning solution is supplied to the cleaning solution that is retained in the cleaning area, the concentration of dirt in the cleaning solution that is inside the cleaning area can be reduced. Accordingly, the cleaning member can clean the transporting belt with the cleaning solution whose the concentration of dirt is within an allowable concentration range and, thus, the cleaning efficiency can be improved.

Furthermore, the concentration of dirt in the cleaning solution that is retained in the cleaning area can be maintained at or below a predetermined level, and, further, dirt, foreign matter, and the like that have settled at the bottom of the cleaning area can be discharged from the cleaning area.

In the belt cleaning apparatus according to the first aspect, in which a plurality of grooves that extend from the cleaning solution supply portion towards the partition portion are preferably provided at the bottom portion of the cleaning area.

Since the plurality of grooves that extend from the cleaning solution supply portion towards the partition portion are provided, it is possible to carry dirt and the like that have settled at the bottom portion out into the liquid discharge area by guiding the cleaning solution that has been supplied into the cleaning area with the grooves. Accordingly, the discharge of dirt can be facilitated.

In the belt cleaning apparatus according to the first aspect, the guide member is preferably formed as a plate-shaped member and is preferably provided so as to extend in a direction that intersects the flow direction of the cleaning solution flowing from the cleaning solution supply portion towards the partition portion.

Since the guide member is provided so as to extend in the direction that intersects the flow direction of the cleaning solution flowing from the cleaning solution supply portion towards the partition portion, the cleaning solution can be spread in the direction of intersection. Accordingly, the cleaning solution can be supplied uniformly throughout the whole bottom portion of the cleaning area. Furthermore, the flow of the cleaning solution can be made uniform in the direction of intersection and dirt and the like that locally remain in the cleaning area can be reduced.

Note that the "plate-shaped member" in the present aspect is not limited to a tabular plate but includes, for example, a concave plate, a convex plate, and a corrugated plate.

In the belt cleaning apparatus according to the first aspect, the guide member preferably includes a plurality of guide ridges for which a distance between each other gradually increases from the cleaning solution supply portion in the direction of intersection.

Since the plurality of guide ridges that gradually increase the distance between each other in the direction of intersection are provided, the cleaning solution can be spread along the guide ridges in the direction of intersection and the flow of the cleaning solution can be made uniform in the direction of intersection when the cleaning solution is supplied from the cleaning solution supply portion to the guide member.

In the belt cleaning apparatus according to the first aspect, the guide member preferably includes a plurality of guide grooves for which a distance between each other gradually increases from the cleaning solution supply portion in the direction of intersection.

Since the plurality of guide grooves that gradually increase the distance between each other in the direction of intersection are provided, the cleaning solution can be spread along the guide grooves in the direction of intersection and the flow of the cleaning solution can be made uniform in the direction of intersection when the cleaning solution is supplied from the cleaning solution supply portion to the guide member.

A recording apparatus according to a second aspect of the invention includes a conveying unit including a transporting belt that transports an object to be transported; a recording unit that performs recording on a recording medium, the recording medium being the object to be transported that is on the transporting belt, by ejecting ink from a recording head; and the belt cleaning apparatus according to the first aspect of the invention.

According to the second aspect of the invention, the recording apparatus can obtain advantageous effects similar to those of the first aspect.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
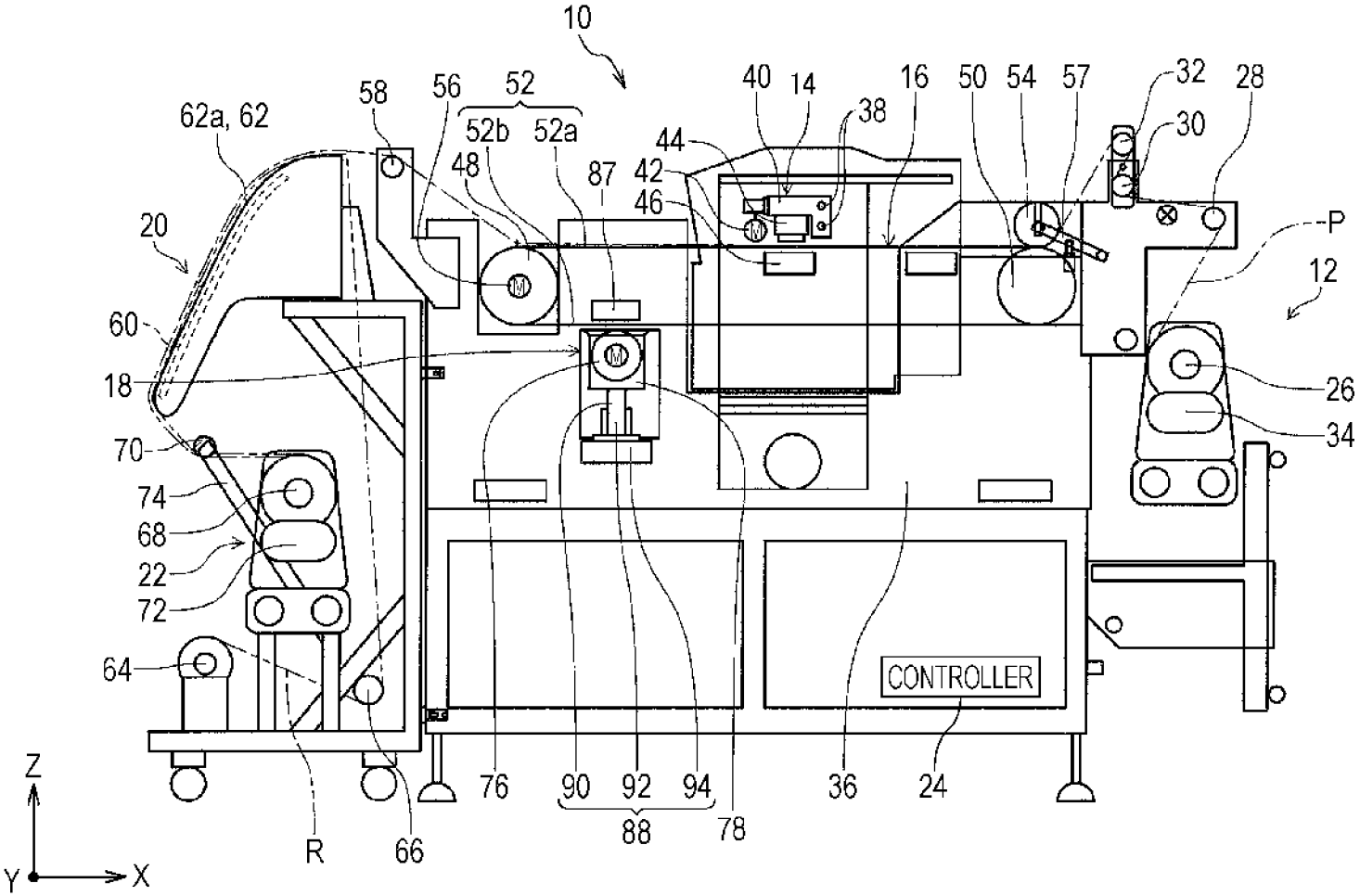
FIG. 1 is a schematic diagram illustrating a recording apparatus according to an exemplary embodiment of the invention.

In the XYZ coordinate system indicated in each drawing, the X-axis direction is a transport direction of the recording medium, the Y-axis direction is a scanning direction of a carriage, and the Z-axis direction is the height direction of the apparatus.

An outline of the overall configuration of a recording apparatus 10 will be described below with reference to FIG. 1. The recording apparatus 10 includes a feeding unit 12, a recording unit 14, a belt conveying unit 16, a belt cleaning apparatus 18, a drying unit 20, a winding unit 22, and a controller 24.

The feeding unit 12 includes a recording medium support shaft 26, a first roller 28, a second roller 30, and a third roller 32. A recording medium P that is a "medium to be transported" is wound in a roll shape around the recording medium support shaft 26. Furthermore, the feeding unit 12 is provided with a rotary drive unit 34 that rotationally drives the recording medium P, which is wound around the recording medium support shaft 26, such that the recording medium P is sent towards the first roller 28. The first roller 28, the second roller 30, and the third roller 32 are rotatably provided in an apparatus body 36.

The recording medium P is driven out by the rotary drive unit 34 from the recording medium support shaft 26, around which the recording medium P is wound, and is transported to the belt conveying unit 16 described below through the first roller 28, the second roller 30, and the third roller 32.

The recording unit 14 is provided with carriage guide shafts 38 that extend in the Y-axis direction in FIG. 1 (the front-back direction of the sheet of FIG. 1). The carriage guide shafts 38 extend through a carriage 40. The carriage 40 is displaced along the carriage guide shafts 38 in the Y-axis direction in FIG. 1 with a carriage motor 42 and a drive mechanism (not shown). Furthermore, the carriage 40 is provided with a recording head 44 that ejects ink towards the recording medium P. In addition, a guide plate 46 is provided below the recording head 44 at a position facing the recording head 44 with a predetermined space between itself and the recording head 44.

The belt conveying unit 16 is arranged in the transport path of the recording medium P downstream of the third roller 32. The belt conveying unit 16 is provided with a transport driving roller 48, a transport driven roller 50, a transporting belt 52, and a pressing roller 54. The transport driven roller 50 is arranged in the transport path downstream of the third roller 32 and the transport driving roller 48 is arranged in the transport path downstream of the transport driven roller 50. The transport driving roller 48 is rotationally driven by a drive motor 56. The transporting belt 52 is wound around the transport driving roller 48 and the transport driven roller 50.

Furthermore, the transporting belt 52, which is wound around the transport driving roller 48 and the transport driven roller 50, includes a upper side portion 52*a* and a lower side portion 52*b* that are positioned on the upper side and the lower side, respectively, in the Z-axis direction in FIG. 1. In the present exemplary embodiment, the upper side portion 52*a* moves from the transport driven roller 50 towards the transport driving roller 48 and the lower side portion 52*b* moves from the transport driving roller 48 towards the transport driven roller 50. In other words, the transport driving roller 50 rotates in a counter clockwise direction in FIG. 1.

Furthermore, the upper side portion 52*a* is positioned so as to pass through a space formed between the recording head 44 and the guide plate 46 in the Z-axis direction. The upper side portion 52*a* is pinched between the transport driven roller 50 and the pressing roller 54. The pressing roller 54 is rotatably arranged at the distal end of a support arm 57 that is supported by the apparatus body 36 in a pivotal manner. Accordingly, the recording medium P that is transported from the third roller 32 is pressed against the upper side portion 52*a* by the pressing roller 54 and is transported to the recording unit 14 by the upper side portion 52*a*.

Furthermore, the recording medium P faces the recording head 44 at the recording unit 14. The recording head 44 ejects ink towards the recording medium P to carry out recording (printing). The recording medium P to which recording has been carried out is then transported downstream of the recording unit 14 with the transport driving roller 48. Furthermore, the lower side portion 52*b* is positioned above the belt cleaning apparatus 18 described later and is cleaned of its ink and foreign matter, which has adhered to the transporting belt 52, by the belt cleaning apparatus 18.

The drying unit 20 is arranged in the transport path downstream of the transport driving roller 48. The drying unit 20 includes a fourth roller 58, a heater 60, and a heat radiation plate 62. The fourth roller 58 is positioned downstream of the transport driving roller 48. The fourth roller 58 pulls the recording medium P that is adhered to the upper side portion 52*a* apart from the upper side portion 52*a* and guides the recording medium P towards the heat radiation plate 62.

The heat radiation plate 62 includes an arcuate radiating surface 62*a*. The heater 60 is provided on the inner side of the radiating surface 62*a*. The recording medium P is transported from the belt conveying unit 16 to an upper end of the radiating surface 62*a* of the heat radiation plate 62 through the fourth roller 58 and is transported along the radiating surface 62*a*. Note that, if the recording medium P has a thickness that does not allow any offsetting of the ink, the recording medium P is winded as it is by the winding unit 22 after passing through the drying unit 20.

Alternatively, if the thickness of the recording medium P allows offsetting of the ink, an interleaf R is provided under the recording medium P in an overlapping manner in the transport path between the fourth roller 58 and the heat radiation plate 62. As illustrated in FIG. 1, the interleaf R is wound around an interleaf roller 64. The interleaf R is pulled out from the interleaf roller 64 and is provided onto the transport path between the fourth roller 58 and the heat radiation plate 62 via a fifth roller 66.

The recording medium P is continuously heated by the heater 60 while being transported along the radiating surface 62*a* of the heat radiation plate 62. This heating evaporates solvent (water content) of the ink that has permeated into the recording medium P and fixes the ink on the fabric serving as a recording medium.

The winding unit 22 includes a recording medium winding shaft 68, a tension roller 70, and a rotary drive unit 72. The recording medium winding shaft 68 is rotationally driven by the rotary drive unit 72 and winds the recording medium P on which drying has been completed in the drying unit 20. The tension roller 70 is rotatably provided at the distal end of a support arm 74 that is attached to the apparatus body 36 in a pivotal manner.

The tension roller 70 rotates while being in contact with the recording medium P that is to be wound onto the recording medium winding shaft 68. Furthermore, the tension roller 70 biases the recording medium P in the Z-axis downward direction with its own weight. Accordingly, the recording medium P is wound onto the recording medium winding shaft 68 while an appropriate tension is applied thereto by the tension roller 70, in other words, the recording medium P is tightly wound onto the recording medium winding shaft 68. Note that when the recording medium P is overlapped with the interleaf R, the tension roller 70 is in contact with the interleaf R side of the overlapped recording medium P and the interleaf R. Furthermore, the interleaf R is wounded onto the recording medium winding shaft 68 together with the recording medium P.

The controller 24 controls the operations of the feeding unit 12, the recording unit 14, the belt conveying unit 16, the belt cleaning apparatus 18, the drying unit 20, and the winding unit 22, as well as the transport speed of the recording medium P, the control of the recording operation, and the like.

The above description is the outline of the overall configuration of the recording apparatus 10 and that of the transport path of the recording medium P. A description of the belt cleaning apparatus 18 according to the first exemplary embodiment will be given next while referring to FIGS. 1 to 3. Note that, in the following description, a running direction of the lower side portion 52*b* of the transporting belt 52 denotes a direction oriented towards an x-axis positive direction in FIG. 1.

First Exemplary Embodiment

The belt cleaning apparatus 18 is positioned below the lower side portion 52*b* of the transporting belt 52. The belt cleaning apparatus 18 includes a rotary brush 76 serving as a "cleaning member", a cleaning solution reservoir 78, a cleaning solution supply portion 80, cleaning solution discharge portions 82, a first wiper 84, and a second wiper 86. Furthermore, a guide plate 87 (see FIG. 1) is provided above the lower side portion 52*b* of the transporting belt 52 at a position that faces the belt cleaning apparatus 18.

Additionally, a Z-axis displacement mechanism 88 that displaces the position of the belt cleaning apparatus 18 in the Z-axis direction in FIG. 1 with respect to the lower side portion 52*b* of the transporting belt 52 is provided below the belt cleaning apparatus 18. The Z-axis displacement mechanism 88 includes a support 90 that supports the lower portion of the cleaning solution reservoir 78, a drive unit 92 that moves the support 90 vertically in the Z-axis direction, and a base 94.

The drive unit 92 is secured to the apparatus body 36 through the base 94. The Z-axis displacement mechanism 88 moves the belt cleaning apparatus 18 vertically in the Z-axis direction to adjust the relative position between the lower side portion 52*b* of the transporting belt 52 and the rotary brush 76. Note that when the belt cleaning apparatus 18 comes into contact with the lower side portion 52*b*, the guide plate 87 supports the lower side portion 52*b* so that the lower side portion 52*b* is maintained in a horizontal state.

The cleaning solution reservoir 78 is a box-shaped container, whose upper portion is open, that extends in the Y-axis direction. The cleaning solution reservoir 78 is provided with a partition plate 98 serving as a "partition portion" that protrudes from a bottom portion 96 of the cleaning solution reservoir 78. The partition plate 98 divides the inside of the cleaning solution reservoir 78 into a reservoir tank 100 that retains the cleaning solution therein and a discharge tank 102 that discharges the cleaning solution towards the cleaning solution discharge portions 82. Furthermore, an upper end 98*a* of the partition plate 98 is positioned below a rotating shaft 104 of the rotary brush 76 described below in the Z-axis direction. Furthermore, the partition plate 98 functions as a "dam" that maintains the liquid level of the cleaning solution in the reservoir tank 100 at a constant level. In other words, the position of the upper end 98*a* in the Z-axis direction is the position of the liquid surface.

The rotary brush 76 is arranged in the reservoir tank 100. The rotary brush 76 includes the rotating shaft 104 and a brush portion 106 that is fitted onto the rotating shaft. The brush portion 106 is provided with a plurality of brushes (not shown) lined up in the axial direction of the rotating shaft 104. Furthermore, in the brush portion 106, the width of the brushes that are provided in the axial direction corresponds to the width of the transporting belt 52.

Figure 2:
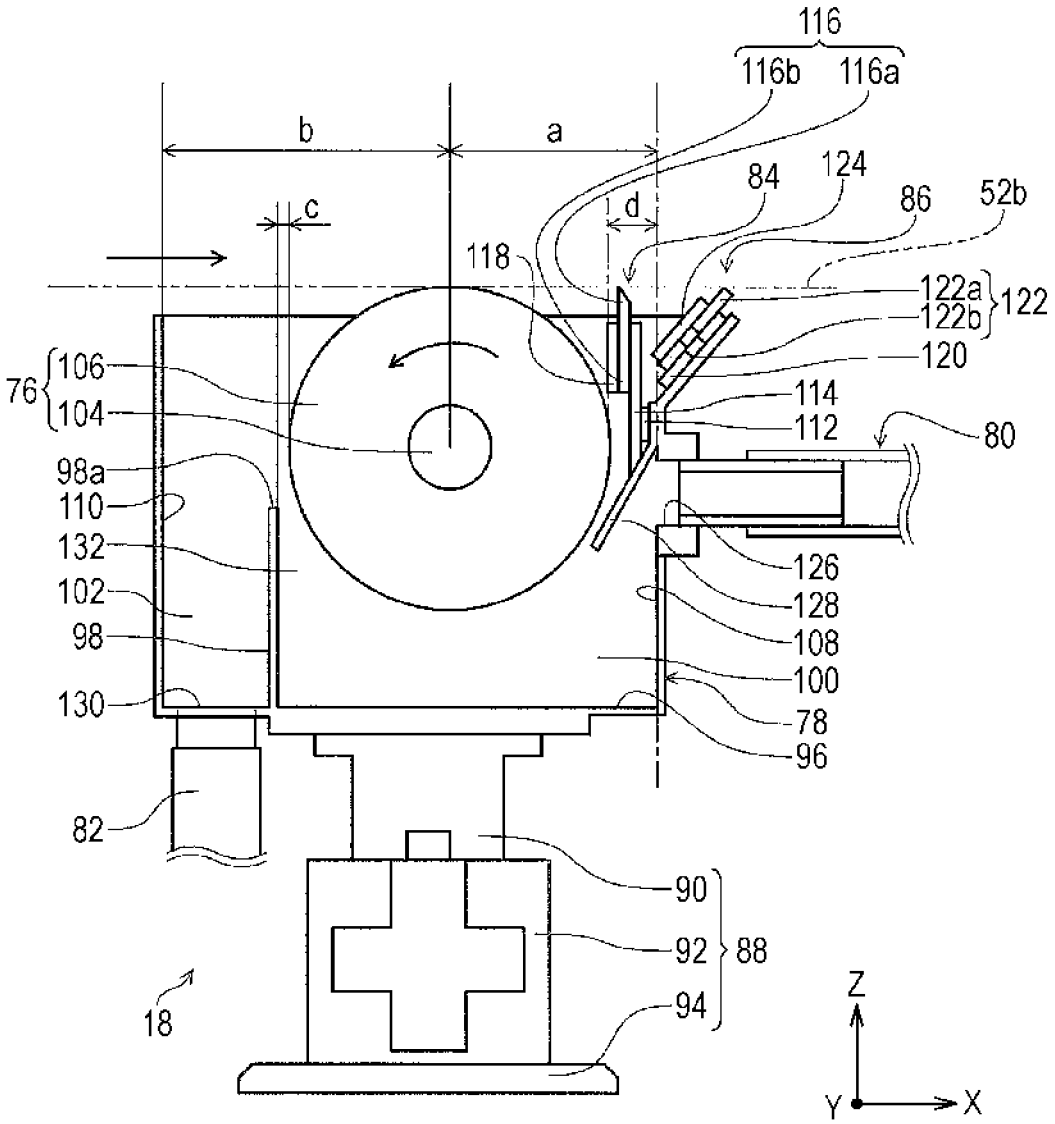
FIG. 2 is a sectional side view of a belt cleaning apparatus according to a first exemplary embodiment.
Figure 3:
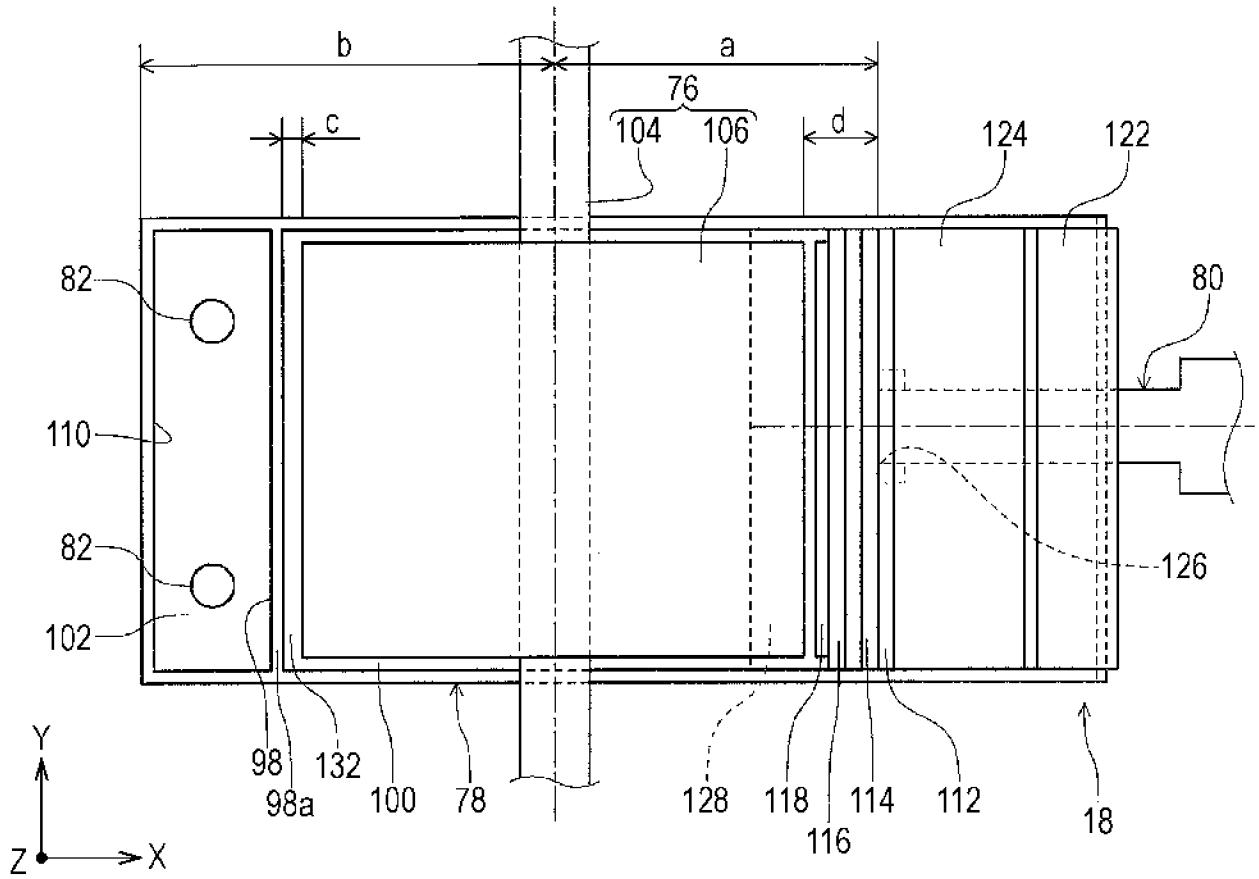
FIG. 3 is a plan view of the belt cleaning apparatus according to the first exemplary embodiment.

As illustrated in FIG. 3, the two ends of the rotating shaft 104 extend such that the rotating shaft 104 exceeds the width of the reservoir tank 100 in the Y-axis direction, in other words, in the width direction of the reservoir tank 100. The two ends of the rotating shaft 104 are supported by bearings (not shown). Furthermore, either one of the two ends of the rotating shaft 104 is connected to a driving source (not shown). Accordingly, the rotating shaft 104 is rotationally driven by the driving source (not shown). In the present exemplary embodiment, the rotary brush 76 is rotated in the counter clockwise direction in FIG. 2 by the driving source (not shown).

Furthermore, referring to FIGS. 2 and 3, in the cleaning solution reservoir 78, the rotating shaft 104 of the rotary brush 76 is positioned closer to the cleaning solution supply portion 80 in the X-axis direction. In other words, in the cleaning solution reservoir 78, the positional relation of the rotating shaft 104 in the X-axis direction is set as follows. A distance a from a side wall 108 of the reservoir tank 100 on the X-axis positive direction side to the rotating shaft 104 is set to be smaller than a distance b from a side wall 110 of the discharge tank 102 on the X-axis negative direction side to the rotating shaft 104. Furthermore, the distance c in the X-axis direction from the rotary brush 76 to the partition plate 98 is set to be smaller than the distance d from the rotary brush 76 to the side wall 108 on the X-axis positive direction side.

Furthermore, at least a portion of the rotating shaft 104 is positioned on the Z-axis positive direction side in FIG. 2 with respect to the upper end 98*a* of the partition plate 98, in other words, at least a portion of the rotating shaft 104 is positioned above the upper end 98*a* of the partition plate 98. Specifically, the position of the upper end 98*a* of the partition plate 98 in the Z-axis direction is set to be below the center of the rotating shaft 104. Furthermore, it is desirable that the position of the upper end 98*a* of the partition plate 98 in the Z-axis direction be positioned below the lower end of the rotating shaft 104. Note that, in the present exemplary embodiment, the position of the upper end 98*a* of the partition plate 98 in the Z-axis direction is set to be below the lower end of the rotating shaft 104.

Furthermore, as regards the rotary brush 76, at least a portion of the brush portion 106 is dipped in the cleaning solution inside the reservoir tank 100. In other words, at least a portion of the rotary brush 76 is positioned below the liquid surface of the cleaning solution of the reservoir tank 100.

Furthermore, a two-dot chain line drawn in FIG. 2 that is in contact with the rotary brush 76 indicates the lower side portion 52*b* of the transporting belt 52. In FIG. 2, the lower side portion 52*b* moves from the X-axis negative direction side to the X-axis positive direction side as illustrated by an arrow. Conversely, in the present exemplary embodiment, the rotary brush 76 rotates in the counter clockwise direction in FIG. 2. In other words, the lower side portion 52*b* and the rotary brush 76 move in opposite directions at the portion where they come into contact with each other. Accordingly, since the relative speed between the rotary brush 76 and the lower side portion 52*b* becomes higher, the rotary brush can improve the efficiency with which it cleans the transporting belt 52.

The first wiper 84 and the second wiper 86 are provided downstream of the rotary brush 76 in the movement direction of the transporting belt 52. The first wiper 84 includes a spacer 112, a first fixing plate 114, a first wiper blade 116, and a wiper blade pressing member 118. The first fixing plate 114 is attached inside the upper end portion of the side wall 108 with one spacer 112 interposed between one first fixing plate 114 and the side wall 108.

The first wiper blade 116 includes a tip 116*a* and a base end 116*b*. The wiper blade pressing member 118 is fixed to the first fixing plate 114 with a screw member (not shown) while the base end 116*b* of the first wiper blade 116 is pushed against the first fixing plate 114. The tip 116*a* of the first wiper blade 116 is in contact with the lower side portion 52*b* of the transporting belt 52 to scrape off dirt that has not been removed by the rotary brush 76 and the cleaning solution. The first wiper blade 116 is constituted by a soft elastic material (silicone rubber, for example). Note that the first wiper 84 is arranged in an upright position when the belt cleaning apparatus 18 is viewed from the side (see FIG. 2).

The second wiper 86 is provided downstream of the first wiper 84 in the movement direction of the transporting belt 52. The second wiper 86 includes a second fixing plate 120, a second wiper blade 122, and a wiper blade pressing member 124. The second fixing plate 120 is fixed in an inclined position with respect to the side wall 108.

The second wiper blade 122 includes a tip 122*a* and a base end 122*b*. The wiper blade pressing member 124 is fixed to the second fixing plate 120 with a screw member (not shown) while the base end 122*b* of the second wiper blade 122 is pushed against the second fixing plate 120. An edge portion positioned at the upper portion of the inclined second wiper blade 122 is in contact with the lower side portion 52*b* of the transporting belt 52; accordingly, the tip 122*a* of the second wiper blade 122 scrapes off dirt and the cleaning solution that have not been removed by the rotary brush 76 and the first wiper blade 116.

Furthermore, the second wiper blade 122 is constituted by an elastic material (urethane rubber, for example) that is relatively harder than the first wiper blade 116. Note that the second wiper 86 is arranged in an inclined position that is inclined towards the downstream side in the movement direction of the transporting belt 52 when the belt cleaning apparatus 18 is viewed from the side (see FIG. 2).

Accordingly, in the present exemplary embodiment, the transporting belt 52 is cleaned by the rotary brush 76, to which the cleaning solution adheres, at the lower side portion 52*b* such that dirt and foreign matter that have adhered to the surface of the belt are removed by the rotary brush 76. Furthermore, dirt, foreign matter, and the cleaning solution that have not been removed by the rotary brush 76 are removed by the first wiper blade 116 or the second wiper blade 122.

Subsequently, a configuration of the cleaning solution reservoir 78 and a flow path of the cleaning solution will be described with reference to FIGS. 2 and 3. The cleaning solution supply portion 80 is provided in the side wall 108 of the cleaning solution reservoir 78 on the X-axis positive direction side, in other words, the cleaning solution supply portion 80 is provided in the side wall 108 of the reservoir tank 100 on the X-axis positive direction side. The cleaning solution supply portion 80 supplies the cleaning solution to the reservoir tank 100 from a cleaning solution tank (not shown) that is provided in the apparatus body 36 through an opening 126 provided in the side wall 108. Furthermore, the opening 126 is provided in the side wall 108 so that at least a portion of the opening 126 is positioned below the upper end 98*a* of the partition plate 98. In other words, the cleaning solution supply portion 80 supplies a portion of the cleaning solution under the liquid surface, which is defined by the upper end 98*a*.

Furthermore, a plate-shaped guide member 128 is provided in front of the opening 126 of the cleaning solution supply portion 80, in other words, the plate-shaped guide member 128 is provided on the reservoir tank 100 side with respect to the opening 126. The guide member 128 protrudes from the side wall 108 and extends obliquely downward (X-axis negative direction and Z-axis negative direction in FIG. 2). Furthermore, as illustrated in FIG. 3, the guide member 128 is provided so as to extend in the width direction (Y-axis direction in FIG. 3) of the cleaning solution reservoir 78, that is, the width direction of the reservoir tank 100. In other words, the guide member 128 guides the cleaning solution that has been supplied from the opening 126 towards the bottom portion 96 of the reservoir tank 100. Furthermore, the guide member 128 spreads the cleaning solution that has been supplied from the opening 126 in the width direction (Y-axis direction in FIG. 3) of the reservoir tank 100.

Furthermore, a plurality of cleaning solution discharge portions 82 are provided at a bottom portion 130 of the cleaning solution reservoir 78, that is, at the bottom portion 130 of the discharge tank 102, spaced apart from each other in the above-described width direction. The cleaning solution that has flowed, that is, overflowed, over the upper end 98*a* of the partition plate 98 and that has flowed out from the reservoir tank 100 into the discharge tank 102 is discharged from the discharge tank 102 through the cleaning solution discharge portions 82. The cleaning solution discharge portions 82 return the cleaning solution, which has been discharged, back to the cleaning solution tank (not shown) through a filter (not shown). In other words, the belt cleaning apparatus 18 is configured such that the cleaning solution circulates from the cleaning solution tank (not shown) through the cleaning solution supply portion 80, the reservoir tank 100, the discharge tank 102, and the cleaning solution discharge portions 82.

The flow path of the cleaning solution will be described now. The cleaning solution is supplied from the cleaning solution supply portion 80 into the reservoir tank 100 through the opening 126. Then, the cleaning solution that has been supplied from the opening 126 is spread by the guide member 128 in the width direction (Y-axis direction in FIG. 3) of the reservoir tank 100 and is guided towards the bottom portion 96 of the reservoir tank 100.

Next, the cleaning solution that has been spread out in the width direction of the reservoir tank 100 at the bottom portion 96 of the reservoir tank 100 moves in the X-axis negative direction in FIG. 2. Now, dirt and foreign matter that have settled at the bottom portion 96 are also carried away in the X-axis negative direction. Then, the flow of the cleaning solution that has moved to the vicinity of the partition plate 98 impinges on the partition plate 98 and the flow direction is changed so as to flow from the bottom portion 96 to the upper end 98*a* of the partition plate 98. Accordingly, dirt and foreign matter that have been carried away from the bottom portion 96 to the vicinity of the partition plate 98 with the flow of the cleaning solution are stirred up towards the upper end 98*a*.

Now, a flow path 132 formed between the partition plate 98 and the rotary brush 76 becomes gradually narrower towards the upper end 98*a* of the partition plate 98. Accordingly, when the cleaning solution passes from the bottom portion 96 to the flow path 132 and moves towards the upper end 98*a* of the partition plate 98, since the flow path 132 becomes gradually narrower, the pressure increases and the flow velocity becomes higher. Accordingly, dirt and foreign matter that are stirred up in the vicinity of the partition plate 98 are caught by the high velocity flow of the cleaning solution and are discharged from the upper end 98*a*. As a result, the removal of dirt, foreign matter, and the like from inside the reservoir tank 100 is facilitated.

Furthermore, the flow direction of the cleaning solution and the rotating direction of the rotary brush 76 are opposite each other in the flow path 132. Accordingly, the flow velocity of the cleaning solution that passes through the flow path 132 becomes higher and, thus, the relative speed between the rotary brush 76 and the cleaning solution becomes higher. This allows the cleaning ability of the cleaning solution, which passes through the flow path 132, at removing dirt from the rotary brush 76 to be improved.

Furthermore, the cleaning solution that has passed through the flow path 132 and that has flowed, that is, overflowed, over the upper end 98*a* of the partition plate 98 is discharged towards the cleaning solution tank (not shown) from the discharge tank 102 together with dirt and foreign matter through the cleaning solution discharge portions 82. Moreover, the cleaning solution that has been discharged from the cleaning solution discharge portions 82 has its dirt, foreign matter, and the like removed therefrom by the filter (not shown), is returned to the cleaning solution tank, and is supplied to the reservoir tank 100 again through the cleaning solution supply portion 80.

Accordingly, concentration of dirt in the cleaning solution that is in the reservoir tank 100 can be maintained within an allowable concentration range. This allows the concentration of dirt in the cleaning solution, which adheres to the brush portion 106 of the rotary brush 76, to be within the allowable concentration range; accordingly, the belt cleaning apparatus 18 can improve its ability to clean the transporting belt 52.

Second Exemplary Embodiment

A belt cleaning apparatus 134 according to a second exemplary embodiment will be described with reference to FIG. 4. The belt cleaning apparatus 134 according to the second exemplary embodiment is different from the belt cleaning apparatus 18 of the first exemplary embodiment in that concavities and convexities are formed in the bottom portion of the reservoir tank 100.

Figure 4:
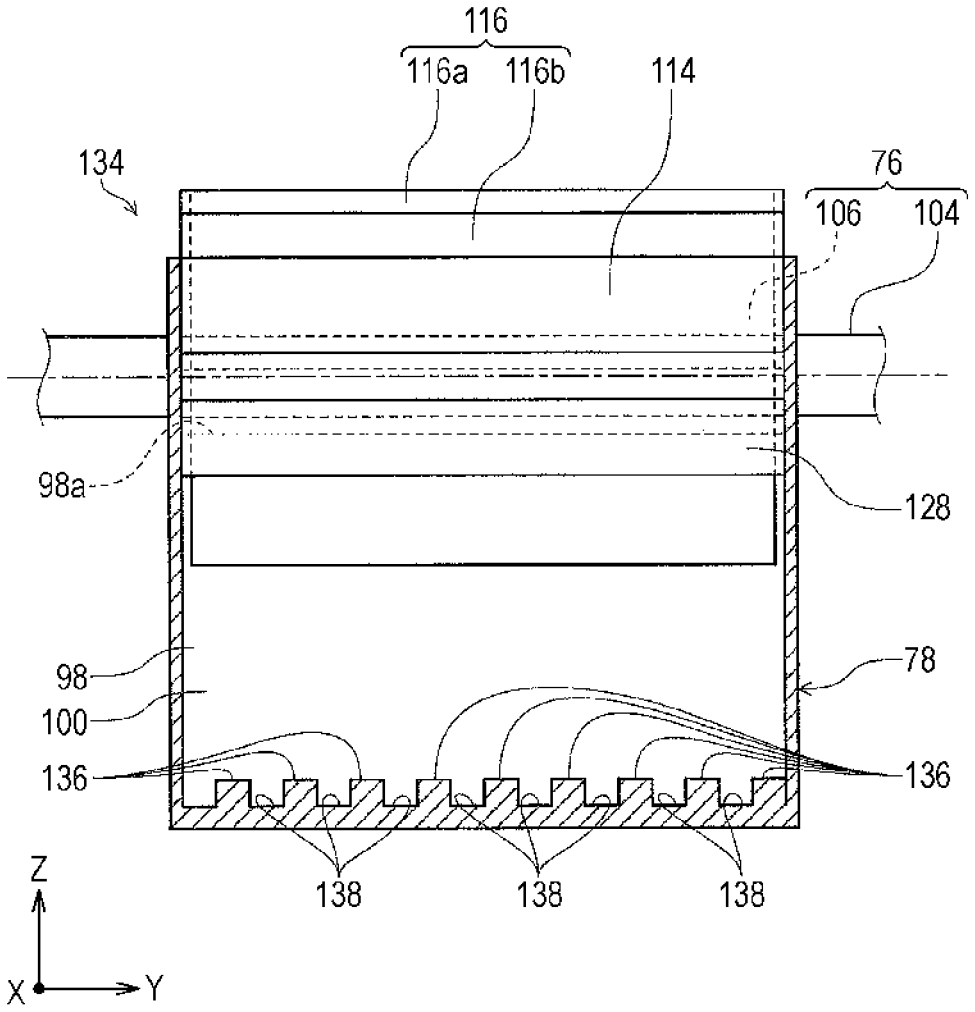
FIG. 4 is a sectional side view of a bottom portion of a belt cleaning apparatus according to a second exemplary embodiment.

As illustrated in FIG. 4, a plurality of grooves 138 are formed at a predetermined interval in a bottom portion 136 of the reservoir tank 100 in the width direction of the reservoir tank 100, that is, in the Y-axis direction of the reservoir tank 100. The grooves 138 extend in the X-axis direction from the side wall 108 of the reservoir tank 100 on the X-axis positive direction side to the partition plate 98. Accordingly, the cleaning solution that has been guided by the guide member 128 from the opening 126 to the bottom portion 136 flows along the grooves 138.

Accordingly, the cleaning solution flows from the opening 126 to the partition plate 98 along the grooves 138 in a uniform manner; thus, dirt and foreign matter that have settled at the bottom portion 136 can be carried away more easily towards the flow path 132. As a result, the concentration of dirt in the cleaning solution that is in the reservoir tank 100 can be maintained within the allowable concentration range.

Exemplary Modification of Second Exemplary Embodiment (1) As illustrated in FIG. 4, the grooves 138 in the present exemplary embodiment have a rectangular cross-sectional shape; however, the grooves 138 may alternatively have a V-shaped cross section.

(2) The grooves 138 in the present exemplary embodiment extend in the X-axis direction from the side wall 108 of the reservoir tank 100 on the X-axis positive direction side to the partition plate 98; however, the grooves may be provided partially between the side wall 108 and the partition plate 98.

Third Exemplary Embodiment

A belt cleaning apparatus 140 according to a third exemplary embodiment will be described with reference to FIG. 5. The belt cleaning apparatus 140 according to the third exemplary embodiment is different from the belt cleaning apparatus 18 of the first exemplary embodiment in that guide ridges that guide the cleaning solution are provided in the guide member 128.

Figure 5:
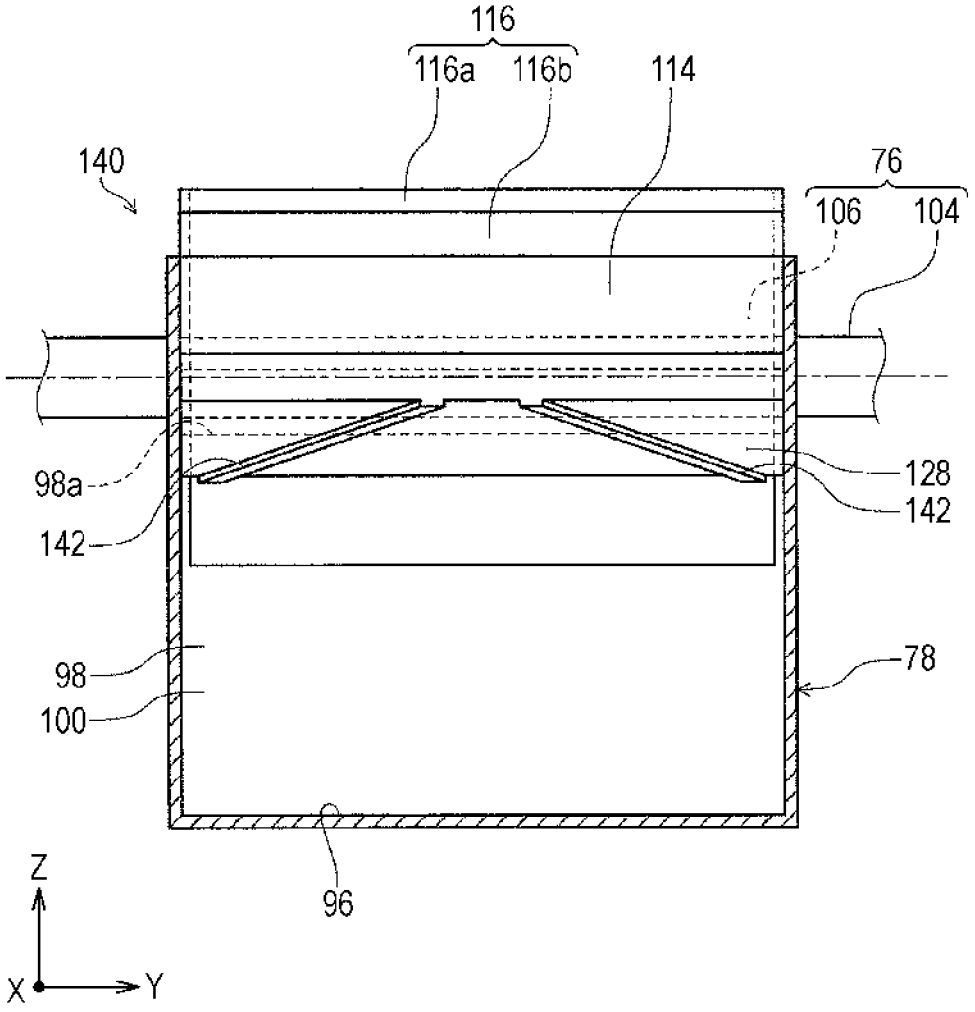
FIG. 5 is a sectional side view of a guide member of the belt cleaning apparatus according to a third exemplary embodiment.

As illustrated in FIG. 5, the guide member 128 of the present exemplary embodiment is provided with a pair of convexed guide ridges 142 that spread the cleaning solution from the opening 126 in the width direction of the reservoir tank 100, in other words, the plurality of convexed guide ridges 142 spread the cleaning solution in a direction that intersects the direction of the flow of the cleaning solution. The guide ridges 142 of the present exemplary embodiment are formed so that they gradually become wider apart in the width direction of the reservoir tank 100, that is, in the Y-axis direction (see FIG. 5), from a position in the guide member 128 that faces the opening 126. In other words, the guide ridges 142 are formed so that the distance between the guide ridges 142 become gradually larger in the Y-axis direction.

Accordingly, the cleaning solution that has been supplied from the opening 126 is guided towards the bottom portion 96 of the reservoir tank 100 while spreading out in the width direction of the reservoir tank 100 (Y-axis direction) along the guide ridges 142. Accordingly, the flow of the cleaning solution in the width direction of the reservoir tank 100 (Y-axis direction) can be made uniform.

Exemplary Modifications of Third Exemplary Embodiment (1) Although the configuration of the present exemplary embodiment includes the convexed guide ridges 142, the configuration may alternatively include a plurality of guide grooves as an alternative to the guide ridges 142.

(2) In the present exemplary embodiment, the guide ridges 142 are a pair of guide ridges. However, this configuration may alternatively include a plurality of guide ridges, which extend in the width direction and towards the bottom portion 96 from a position that faces the opening 126 while a predetermined angle is formed between the adjacent guide ridges.

Exemplary Modifications of First Exemplary Embodiment to Third Exemplary Embodiment (1) In the first exemplary embodiment to the third exemplary embodiment, the rotary brush 76 has the plurality of brushes. However, the configuration may alternatively include plate-shaped rubber members that each extend in the axial direction of the rotating shaft 104 and that are provided at uniform intervals in the circumferential direction of the rotating shaft 104. Alternatively, the rotary brush 76 may have a plate-shaped rubber member provided in an inclined manner in the axial direction of the rotating shaft 104 so as to form a spiral. Alternatively, the brush portion 106 may have a sponge or the like that is impregnated with the cleaning solution.

(2) In the first exemplary embodiment to the third exemplary embodiment, the first wiper blade 116 and the second wiper blade 122 are formed of different materials. However, the first wiper blade 116 and the second wiper blade 122 may be formed of the same material.

(3) In the first exemplary embodiment to the third exemplary embodiment, the position of the upper end 98*a* of the partition plate 98 in the Z-axis direction is set to be below the lower end of the rotating shaft 104 that is further below the center of the rotating shaft 104. However, the position of the upper end 98*a* of the partition plate 98 in the Z-axis direction may alternatively be set to be between the center and the upper end of the rotating shaft 104.

(4) In the first exemplary embodiment to the third exemplary embodiment, the "partition portion" is constituted by the tabular partition plate 98. However, the "partition portion" is not limited to a tabular member and may be any member or the like that can partition the cleaning solution reservoir 78 into the reservoir tank 100 and the discharge tank 102.

A summary will be made of the above description. The belt cleaning apparatuses 18, 134, and 140 of the exemplary embodiments are each a belt cleaning apparatus that cleans the surface of the transporting belt 52 with the cleaning solution and each include the rotatable rotary brush 76 that is positioned below the transporting belt 52 and that cleans the surface of the transporting belt 52 with the cleaning solution, the cleaning solution reservoir 78 that retains the cleaning solution into which a portion of the rotary brush 76 is dipped, and the cleaning solution discharge portions 82 that discharges the cleaning solution, which has been supplied to the cleaning solution reservoir 78, from the cleaning solution reservoir 78. The cleaning solution reservoir 78 is provided with the partition plate 98 that protrudes from the bottom portion 96 of the cleaning solution reservoir 78. The cleaning solution, which has flowed over the upper end 98*a* of the partition plate 98, is discharged from the cleaning solution reservoir 78 into the cleaning solution discharge portions 82. The flow path 132 that is formed by the partition plate 98 and the rotating rotary brush 76 and that is a flow path that leads the cleaning solution towards the cleaning solution discharge portions 82 becomes gradually narrower towards the upper end 98*a* of the partition plate 98.

The upper end 98*a* of the partition plate 98 is positioned below the rotating shaft 104 of the rotary brush 76. The cleaning solution supply portion 80 that supplies the cleaning solution to the cleaning solution reservoir 78 is provided. In the cleaning solution reservoir 78, the cleaning solution supply portion 80 supplies a portion of the cleaning solution under the liquid surface of the cleaning solution, which is defined by the upper end 98*a* of the partition plate 98.

The rotating direction of the rotary brush 76 is opposite to the running direction of the lower side portion 52*b* of the transporting belt 52. In the cleaning solution reservoir 78, the rotating shaft 104 of the rotary brush 76 is arranged closer to the side that is provided with the cleaning solution supply portion 80, in other words, the rotating shaft 104 of the rotary brush 76 is arranged closer to the side wall 108. The distance c between the partition plate 98 and the rotary brush 76 in the running direction of the transporting belt 52 is smaller than the distance d between the side wall 108 of the cleaning solution reservoir 78, which is the side provided with the cleaning solution supply portion 80, and the rotary brush 76.

The cleaning solution supply portion 80 includes the guide member 128 that guides the cleaning solution, which has been supplied to the cleaning solution reservoir 78 from the cleaning solution supply portion 80, towards the bottom portion 96 of the cleaning solution reservoir 78.

The plurality of grooves 138 that extend from the cleaning solution supply portion 80 to the cleaning solution discharge portions 82 side is provided at the bottom portion 96 of the cleaning solution reservoir 78. The guide member 128 is formed as a tabular member. The guide member 128 is provided so as to extend in a direction that intersects the flow direction of the cleaning solution flowing from the cleaning solution supply portion 80 towards the cleaning solution discharge portions 82, in other words, the guide member 128 is provided in the width direction (Y-axis direction) of the cleaning solution reservoir 78.

The guide member 128 includes the plurality of guide ridges 142 that gradually increase the distance between each other from the cleaning solution supply portion 80 in the direction of intersection, in other words, in the width direction (Y-axis direction) of the cleaning solution reservoir 78. Alternatively, the guide member 128 includes the plurality of guide grooves that gradually increase the distance between each other from the cleaning solution supply portion 80 in the direction of intersection, in other words, in the width direction (Y-axis direction) of the cleaning solution reservoir 78.

The recording apparatus 10 includes the belt conveying unit 16 that includes the transporting belt 52 that transports the object to be transported, the recording unit 14 that carries out recording by ejecting ink on the recording medium P, which is the object to be transported that is on the transporting belt 52, from the recording head 44, and the belt cleaning apparatus 18, 134, or 140.

Furthermore, in the exemplary embodiments, the belt cleaning apparatus according to the invention is applied to an ink jet printer that is an example of the recording apparatus; however, the belt cleaning apparatus according to the invention can be applied to any other liquid ejecting apparatus.

Here, the liquid ejecting apparatus is not limited to a recording apparatus such as a printer, a copying machine, or a facsimile machine that carries out recording on a recording medium by using an ink jet recording head to eject ink from the recording head, but also includes an apparatus that ejects liquid, which meets the purpose of the apparatus and is provided in place of the ink, onto a medium to be ejected, which corresponds to the recording medium, from a liquid ejection head, which corresponds to the ink jet recording head, to deposit the liquid onto the medium to be ejected.

Other than the recording head described above, the liquid ejection head may include, for example, a color material ejection head that is used to manufacture color filters for liquid crystal displays and the like, an electrode material (conductive paste) ejection head that is used to form electrodes for organic EL displays, surface emitting displays (FED), and the like, a bio organic matter ejecting head used to manufacture biochips, and a sample ejection head serving as a precision pipette.

Note that the invention is not limited to the exemplary embodiments described above and may be modified in various ways that is within the scope of the claims. It goes without saying that the modifications are also included in the scope of the invention.

The entire disclosure of Japanese Patent Application No.: 2013-005188, filed Jan. 16, 2013 and 2013-005277, filed Jan. 16, 2013 and 2013-225059, filed Oct. 30, 2013 are expressly incorporated by reference herein.

What is claimed is:

1. A belt cleaning apparatus that cleans a surface of a transporting belt with a cleaning solution, the belt cleaning apparatus comprising:

a cleaning member that is in contact with the surface in a rotatable manner, the cleaning member cleaning the surface with the cleaning solution, the cleaning member including a rotating shaft around which the cleaning member rotates;

a cleaning solution reservoir that retains the cleaning solution; and a partition portion that protrudes from a bottom portion of the cleaning solution reservoir, the partition portion partitioning the cleaning solution reservoir into a cleaning area in which the cleaning member is partially dipped in the cleaning solution and a discharging area from which the cleaning solution is discharged, wherein a distance from a sidewall of the cleaning solution reservoir on the discharging area side to the rotating shaft is greater than a distance from a sidewall of the cleaning solution reservoir on the cleaning area side to the rotating shaft, wherein distance from the cleaning member to the partition portion is less than a distance from the cleaning member to the sidewall of the cleaning solution reservoir on the cleaning area side, wherein the discharging area is smaller than the cleaning area, wherein a distance between the cleaning member and the partition portion becomes gradually smaller towards an upper end of the partition portion.

2. The belt cleaning apparatus according to claim 1, wherein the upper end of the partition portion is positioned below a rotating shaft of the cleaning member.

3. A recording apparatus, comprising:

a conveying unit including a transporting belt that transports an object to be transported;

a recording unit that performs recording on a recording medium, the recording medium being the object to be transported that is on the transporting belt, by ejecting ink from a recording head; and the belt cleaning apparatus according to claim 2.

4. The belt cleaning apparatus according to claim 1, further comprising a cleaning solution supply portion that supplies the cleaning solution to the cleaning area, wherein the cleaning solution supply portion supplies, in the cleaning area, at least a portion of the cleaning solution below the liquid surface of the cleaning solution that is defined by the upper end of the partition portion.

5. The belt cleaning apparatus according to claim 4, wherein a rotating direction of the cleaning member is opposite to a running direction of the transporting belt.

6. A recording apparatus, comprising:

a conveying unit including a transporting belt that transports an object to be transported;

a recording unit that performs recording on a recording medium, the recording medium being the object to be transported that is on the transporting belt, by ejecting ink from a recording head; and the belt cleaning apparatus according to claim 5.

7. The belt cleaning apparatus according to claim 4, wherein a distance between the partition portion and the cleaning member in the running direction of the transporting belt is smaller than a distance between a side wall of the cleaning solution reservoir that is on the side provided with the cleaning solution supply portion and the cleaning member.

8. A recording apparatus, comprising:

a conveying unit including a transporting belt that transports an object to be transported;

a recording unit that performs recording on a recording medium, the recording medium being the object to be transported that is on the transporting belt, by ejecting ink from a recording head; and the belt cleaning apparatus according to claim 7.

9. The belt cleaning apparatus according to claim 4, wherein the cleaning solution supply portion includes a guide member that guides the cleaning solution that has been supplied to the cleaning area from the cleaning solution supply portion towards the bottom portion of the cleaning area.

10. The belt cleaning apparatus according to claim 9, wherein a plurality of grooves that extend from the cleaning solution supply portion towards the partition portion are provided at the bottom portion of the cleaning area.

11. A recording apparatus, comprising:

a conveying unit including a transporting belt that transports an object to be transported;

a recording unit that performs recording on a recording medium, the recording medium being the object to be transported that is on the transporting belt, by ejecting ink from a recording head; and the belt cleaning apparatus according to claim 10.

12. The belt cleaning apparatus according to claim 9, wherein the guide member is formed as a plate-shaped member, and the guide member is provided so as to extend in a direction that intersects the flow direction of the cleaning solution flowing from the cleaning solution supply portion towards the partition portion.

13. The belt cleaning apparatus according to claim 12, wherein the guide member includes a plurality of guide ridges for which a distance between each other gradually increases from the cleaning solution supply portion in the direction of intersection.

14. A recording apparatus, comprising:

a conveying unit including a transporting belt that transports an object to be transported;

a recording unit that performs recording on a recording medium, the recording medium being the object to be transported that is on the transporting belt, by ejecting ink from a recording head; and the belt cleaning apparatus according to claim 13.

15. A recording apparatus, comprising:

a conveying unit including a transporting belt that transports an object to be transported;

a recording unit that performs recording on a recording medium, the recording medium being the object to be transported that is on the transporting belt, by ejecting ink from a recording head; and the belt cleaning apparatus according to claim 9.

16. A recording apparatus, comprising:

a conveying unit including a transporting belt that transports an object to be transported;

a recording unit that performs recording on a recording medium, the recording medium being the object to be transported that is on the transporting belt, by ejecting ink from a recording head; and the belt cleaning apparatus according to claim 12.

17. A recording apparatus, comprising:

a conveying unit including a transporting belt that transports an object to be transported;

a recording unit that performs recording on a recording medium, the recording medium being the object to be transported that is on the transporting belt, by ejecting ink from a recording head; and the belt cleaning apparatus according to claim 4.

18. A recording apparatus, comprising:

a conveying unit including a transporting belt that transports an object to be transported;

a recording unit that performs recording on a recording medium, the recording medium being the object to be transported that is on the transporting belt, by ejecting ink from a recording head; and the belt cleaning apparatus according to claim 1.

* * * * *